US010008806B2

(12) United States Patent
Matsunaga et al.

(10) Patent No.: US 10,008,806 B2
(45) Date of Patent: Jun. 26, 2018

(54) LEVER-TYPE CONNECTOR CAPABLE OF OPERABILITY

(71) Applicant: Yazaki Corporation, Minato-ku, Tokyo (JP)

(72) Inventors: Takashi Matsunaga, Makinohara (JP); Kenichi Kawashima, Makinohara (JP); Yosuke Akagi, Makinohara (JP); Kenji Kajikawa, Fujieda (JP); Kotarou Tobino, Fujeida (JP)

(73) Assignee: Yazaki Corporation, Minato-ku, Tokyo (JP)

( * ) Notice: Subject to any disclaimer, the term of this patent is extended or adjusted under 35 U.S.C. 154(b) by 0 days. days.

(21) Appl. No.: 15/799,059

(22) Filed: Oct. 31, 2017

(65) Prior Publication Data

US 2018/0123290 A1 May 3, 2018

(30) Foreign Application Priority Data

Oct. 31, 2016 (JP) ..... 2016-213353

(51) Int. Cl.
*H01R 13/62* (2006.01)
*H01R 13/629* (2006.01)

(52) U.S. Cl.
CPC ..... *H01R 13/62938* (2013.01)

(58) Field of Classification Search
CPC ..... H01R 13/62933; H01R 13/62938; H01R 13/62955; H01R 13/62988
USPC ..... 439/157, 372
See application file for complete search history.

(56) References Cited

U.S. PATENT DOCUMENTS 6,612,854 B2 * 9/2003 Takata ..... H01R 13/62972 439/157
7,427,205 B2 * 9/2008 Sasaki ..... H01R 13/62955 439/157
8,025,513 B2 9/2011 Kobayashi et al.
2011/0086529 A1 4/2011 Kobayashi et al.

FOREIGN PATENT DOCUMENTS

JP 2011-082115 A 4/2011
JP 2013-062078 A 4/2013

* cited by examiner

*Primary Examiner* — Hae Moon Hyeon
(74) *Attorney, Agent, or Firm* — Banner & Witcoff, Ltd.

(57) ABSTRACT

A lever-type connector includes a housing and a lever movably attached to the housing. The lever includes a side plate provided along a side surface of the housing, and an operation portion connected to the side plate. A boss is provided on the side surface of the housing. The side plate of the lever has an elongate hole into which the boss is inserted to restrict a moving range of the lever. An engagement stepped portion is provided at one end of the elongate hole. The engagement stepped portion is recessed on its outer side. The boss has an engagement projection provided at its distal end portion. The engagement projection extends along the elongate hole. The engagement stepped portion and the engagement projection engage with each other in a state in which the lever has been moved in a direction that separates the housing from a counterpart housing.

3 Claims, 9 Drawing Sheets

LEVER-TYPE CONNECTOR CAPABLE OF OPERABILITY

CROSS-REFERENCE TO RELATED APPLICATION

The present application claims priority from Japanese Patent Application No. 2016-213353 filed on Oct. 31, 2016, the entire content of which is incorporated herein by reference.

FIELD OF INVENTION

The present invention relates to a lever-type connector.

RELATED ART

A related art lever-type connector is configured to be connected to a counterpart connector with a low insertion force by operating a lever (see, e.g., JP2011-82115A and JP2013-62078A).

As shown in FIGS. 9A and 9B, the lever-type connector has a lever 102 pivotably provided on a housing 101. The lever 102 is operable to be pivoted between a provisionally locked position (FIG. 9A) and a fully locked position (FIG. 9B) to assist connection and removal with respect to a counterpart housing of the counterpart connector.

The lever 102 has a side plate 103 each a pivot hole 104, and the housing 101 has a pivot boss 105 inserted into the pivot hole 104 such that the lever 102 is pivotable with respect to the housing 101 in a given range. The pivot boss 105 has an engagement projection 106 engaged with an edge portion 104*a* of the pivot hole 104. This engagement between the engagement projection 106 and the edge portion 104*a* of the pivot hole 104 prevents the lever 102 from coming off the housing 101.

However, with this connector, the engagement projection 106 of the pivot boss 105 slides on the edge portion 104*a* of the pivot hole 104 when rotating the lever 102 from the provisionally locked position (FIG. 9A) to the fully locked position (FIG. 9B). This the sliding friction resistance deteriorates the operability of the lever 102.

SUMMARY

Illustrative aspects of the present invention provide a lever-type connector capable of maintaining good operability.

According to an illustrative aspect of the invention, a lever-type connector includes a housing configured to be inserted into and pulled out from a fitting recess formed in a counterpart housing of a counterpart connector, and a lever attached to the housing so as to be movable relative to the housing, the lever being configured to assist, during a movement of the lever, force for inserting and pulling out the housing with respect to the counterpart housing. The lever includes a side plate provided along a side surface of the housing, and an operation portion connected to an end portion of the side plate. The housing includes a boss provided on the side surface of the housing. The side plate of the lever has an elongate hole into which the boss is inserted to restrict a moving range of the lever with respect to the housing, and an engagement stepped portion provided at at least one end of the elongate hole, the engagement stepped portion being recessed on an outer side of the side plate. The boss has an engagement projection provided at a distal end portion of the boss, the engagement projection extending along the elongate hole and being engageable with the engagement stepped portion. The engagement stepped portion and the engagement projection engage with each other in a state in which the lever has been moved in a direction that separates the housing from the counterpart housing.

Other aspects and advantages of the invention will be apparent from the following description, the drawings and the claims.

DETAILED DESCRIPTION

Hereinafter, exemplary embodiments of the present invention will be described with reference to the drawings.

Figure 1:
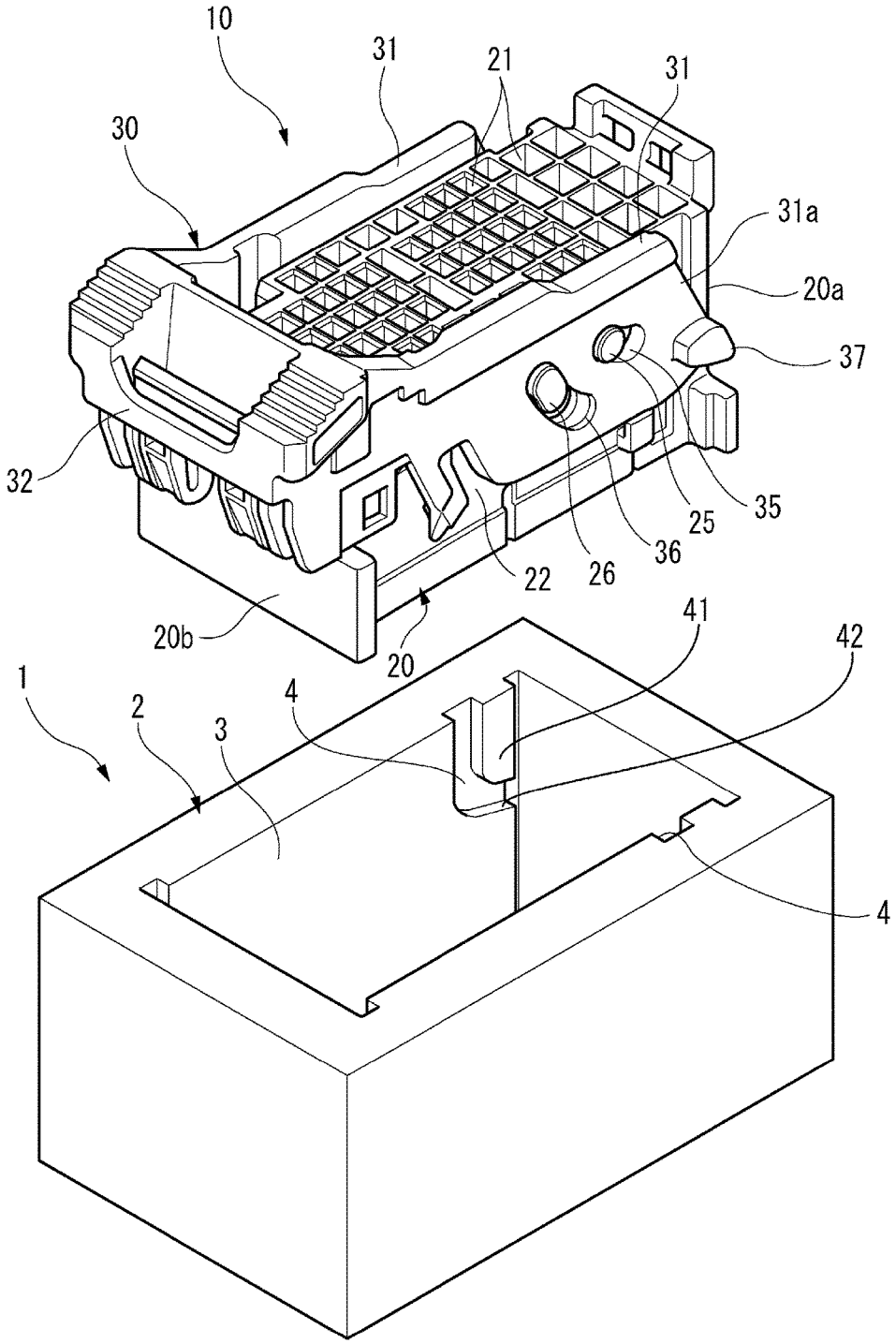
FIG. 1 is a perspective view of a lever-type connector according to exemplary embodiment of the present invention.
Figure 2:
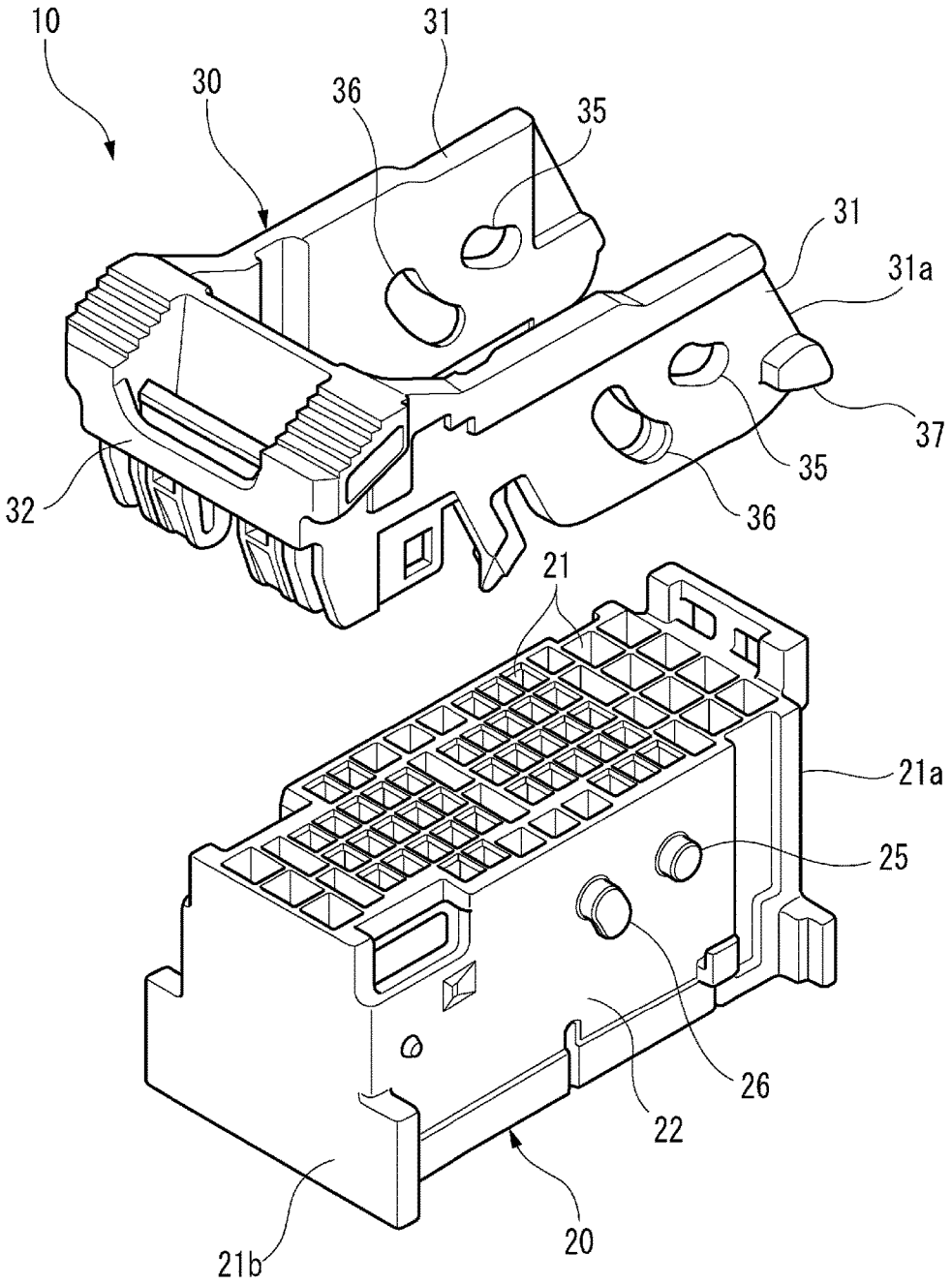
FIG. 2 is an exploded perspective view of the lever-type connector.
Figure 3:
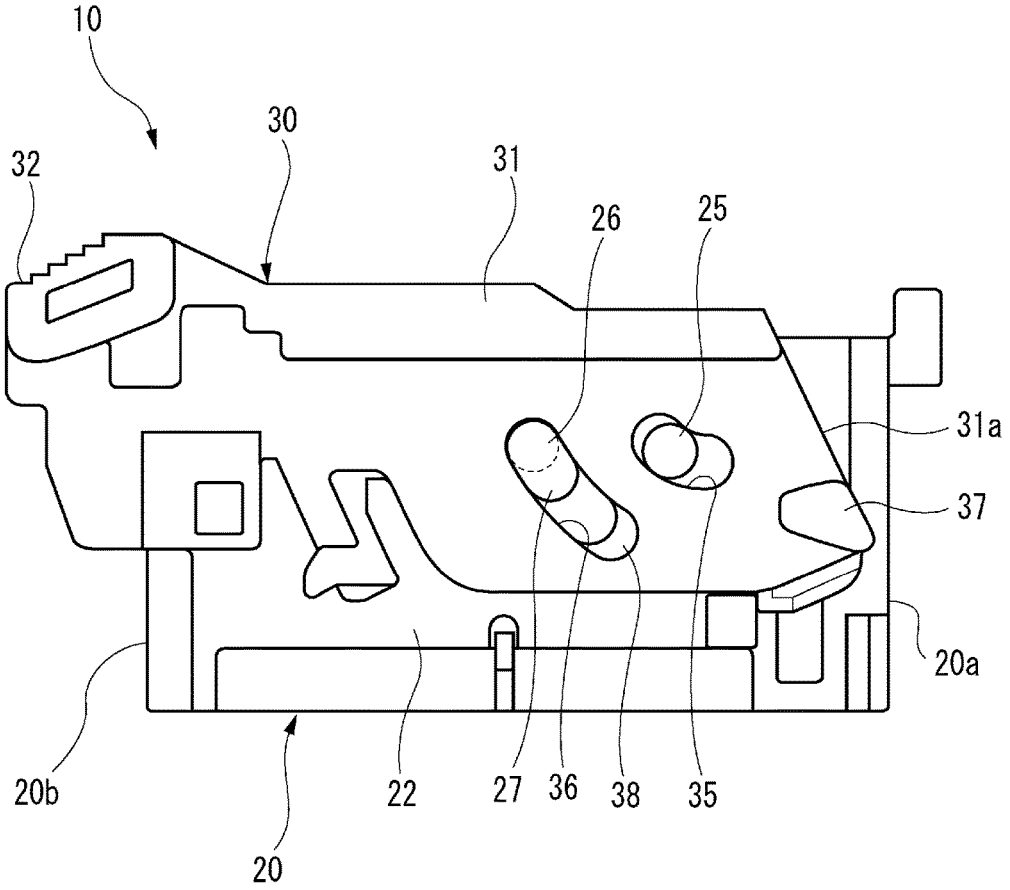
FIG. 3 is a side view of the lever-type connector.

As shown in FIGS. 1 to 3, a lever-type connector 10 according to an exemplary embodiment of the present invention has a housing 20 and a lever 30. The lever-type connector 10 is fitted into a fitting recess 3 formed in a counterpart housing 2 of a counterpart connector 1, thereby being joined to the counterpart connector 1. The joining and separation of the lever-type connector 10 to and from the counterpart connector 1 are assisted by pivoting the lever 30. That is, the lever-type connector 10 is a low insertion force (LIF) connector that is joined to the counterpart connector 1 with a low insertion force by operating the lever 30.

The housing 20 is made of a synthetic resin, and has a plurality of terminal accommodating chambers 21. These terminal accommodating chambers 21 are formed in the direction of joining to the counterpart connector 1, and a terminal (not shown) is accommodated in each of the terminal accommodating chambers 21. The terminals accommodated in these terminal accommodating chambers 21 are electrically connected to the terminals (not shown)

provided in the counterpart housing 2 of the counterpart connector 1 by joining the lever-type connector 10 to the counterpart connector 1.

The housing 20 has a lever support boss 25 and a pivot guide boss 26 (boss) formed on each side surface 22. The lever support bosses 25 are each formed closer to one end 20*a* of the housing 20 in the length direction, and the pivot guide bosses 26 are each formed closer to the center of the housing 20 in the length direction than the lever support bosses 25.

The lever 30 is formed of a synthetic resin, and has a pair of side plates 31 and an operation portion 32. The pair of side plates 31 have end portions thereof coupled by the operation portion 32, whereby the lever 30 is formed in a U shape in a plan view. On each side plate 31, a lever support hole 35 and a pivot guide hole 36 (elongate hole) are formed. The lever support holes 35 are each formed closer to one end 31*a* opposite to the operation portion 32 on the side plate 31, and the pivot guide holes 36 are each formed closer to the operation portion 32 than the lever support hole 35. On each side plate 31 of the lever 30, a cam protrusion 37 protruding outward is formed on one end opposite to the operation portion 32.

The lever 30 is disposed so that the side plates 31 are along the side surfaces 22 of the housing 20, respectively, with the operation portion 32 being disposed on the side of the other end 20*b* of the housing 20. The lever support bosses 25 and the pivot guide bosses 26 of the housing 20 are inserted in the lever support holes 35 and the pivot guide holes 36 of the side plates 31 of the lever 30, respectively.

The lever support holes 35 and the pivot guide holes 36 are formed as elongate holes having arc shapes the centers of which are upper end positions of the one ends 31*a* of the side plates 31 of the lever 30, and the pivot guide holes 36 are longer than the lever support holes 35.

Figure 4A:
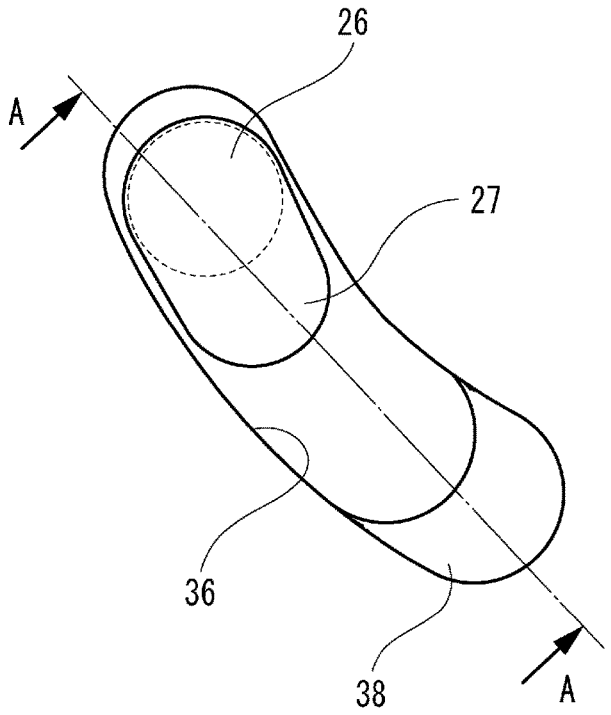
FIG. 4A is a side view of a pivot guide hole and a pivot guide boss in a fully locked state.
Figure 4B:
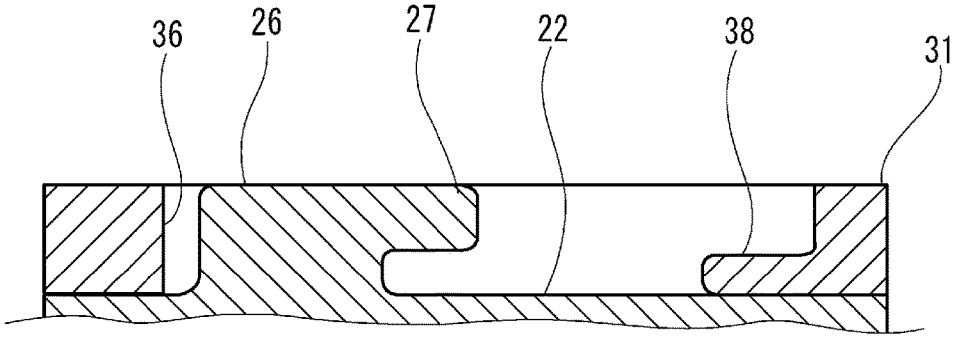
FIG. 4B is a cross-sectional view taken along the line A-A of FIG. 4A.

As shown in FIGS. 4A and 4B, an engagement stepped portion 38 is formed at the lower end of each pivot guide hole 36. The engagement stepped portion 38 is recessed on an outer side of the side plate 31. Each pivot guide boss 26 has an engagement projection 27 provided at its distal end portion. The engagement projection 27 extends downward along the pivot guide hole 36.

Next, an operation for joining the lever-type connector 10 to the counterpart connector 1 will be described.

Figure 5:
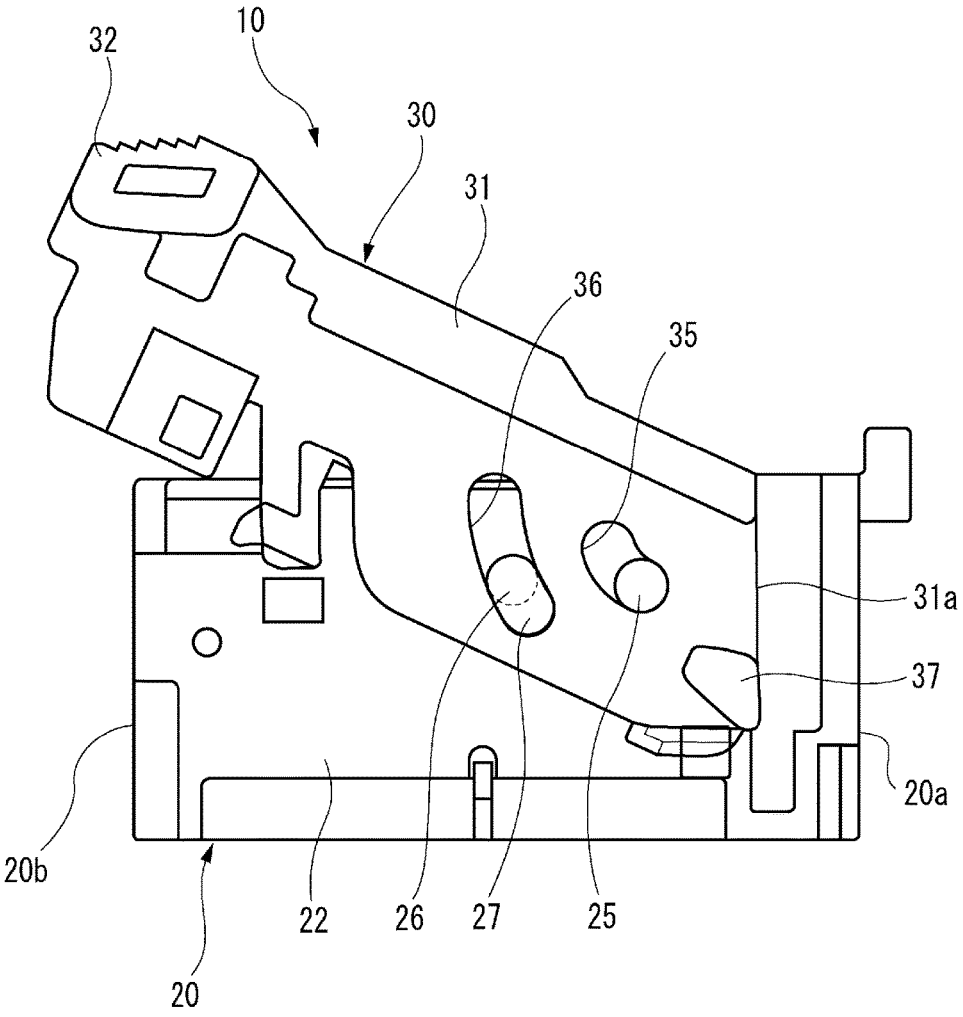
FIG. 5 is a side view of the lever-type connector in a provisionally locked state.

The lever-type connector 10 is first fitted in the counterpart housing 2 of the counterpart connector 1 in the provisionally locked state in which the operation portion 32 of the lever 30 is pivoted so as to be separated from the housing 20 such that the lever 30 is disposed obliquely to the housing 20 as shown in FIG. 5.

Figure 6A:
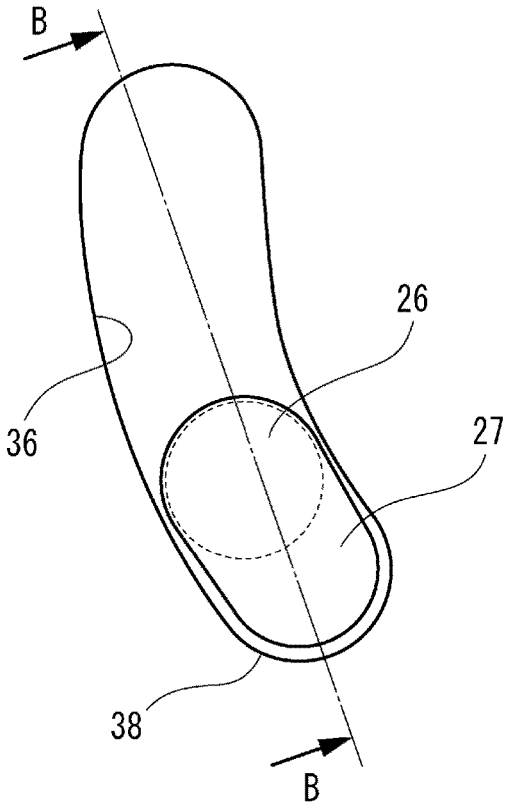
FIG. 6A is a side view of the pivot guide hole and the pivot guide boss in the provisionally locked state.
Figure 6B:
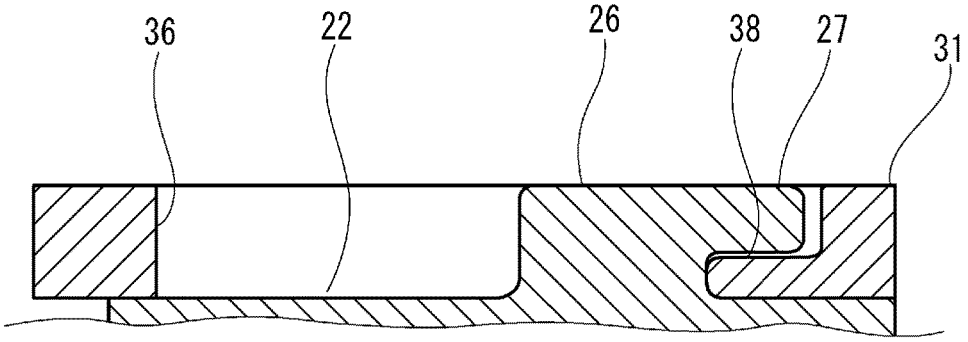
FIG. 6B is a cross-sectional view taken along the line B-B of FIG. 6A.

In this provisionally locked state, as shown in FIGS. 6A and 6B, the engagement projections 27 of the pivot guide bosses 26 of the housing 20 engage with the engagement stepped portions 38 of the pivot guide holes 36 of the lever 30. The engagement force between the engagement stepped portions 38 and the engagement projections 27 restricts the movement of the side plates 31 of the lever 30 in a direction away from the side surfaces 22 of the housing 20. Thus, in this provisionally locked state, the lever 30 does not come off from the housing 20 even if an external force such as a vibration or an impact is applied. This effect is particularly remarkable, for example, in a case where an external force such as a vibration or an impact is applied during a transportation of a harness product having the lever-type connector, in a case where an unfinished harness having the lever-type connector is dropped and an external force due to an impact is applied in the manufacturing process, and in a case where the side plate 31 is caught.

From this provisionally locked state, the housing 20 of the lever-type connector 10 is pushed into the fitting recess 3 of the counterpart housing 2 of the counterpart connector 1. At this time, the cam protrusions 37 formed on the side plates 31 of the lever 30 enter cam grooves 4 formed on the counterpart housing 2 of the counterpart connector 1 (see FIG. 1).

Then, when the housing 20 of the lever-type connector 10 is pushed into the fitting recess 3 of the counterpart housing 2 of the counterpart connector 1 while the operation portion 32 of the lever 30 is being pushed in the joining direction, the cam protrusions 37 having entered the cam grooves 4 engage with fitting fulcrum parts 41 of the cam grooves 4, so that the lever 30 pivots with the cam protrusions 37 serving as a fulcrum. Then, by the pivot of the lever 30, an insertion force is added from the lever 30 to the housing 20 at the positions where the lever support bosses 25 and the lever support holes 35 abut on each other and where the pivot guide bosses 26 and the pivot guide holes 36 abut on each other, so that the housing 20 is pushed in the joining direction which is an anterior direction. Under this condition, the lever 30 is brought into the fully locked state where it is disposed substantially parallel to the housing 20, the lever-type connector 10 is joined to the counterpart connector 1 and the terminals thereof are electrically connected together.

To detach the lever-type connector 10 joined to the counterpart connector 1 from the counterpart connector 1, the operation portion 32 of the lever 30 is manually held, and the operation portion 32 of the lever 30 is pulled up so as to bring the lever-type connector 10 into the provisionally locked state. Then, the cam protrusions 37 of the lever 30 engage with separation fulcrum parts 42 in the cam grooves 4 and the lever 30 pivots with the cam protrusions 37 serving as a fulcrum in a direction opposite to when it is joined, whereby the housing 20 receives a pullout force from the lever 30 and is pulled out in the separation direction which is a posterior direction with respect to the counterpart housing 2. Thereby, the lever-type connector 10 is brought into the provisionally locked state and detached from the counterpart connector 1.

As described above, in the lever-type connector 10, by manually holding the operation portion 32 of the lever 30 and pivoting the lever 30, force for inserting and pulling out the housing 20 with respect to the counterpart housing 2 is assisted via the low insertion force mechanism having the cam grooves 4 and the cam protrusions 37 serving as the fulcrum.

As described above, according to the lever-type connector 10 of the present exemplary embodiment, the side plates 31 are locked to the side surfaces 22 of the housing 20 by the engagement stepped portions 38 and the engagement projections 27 engaging with each other in the provisionally locked state in which the lever 30 has been moved in a direction that separates the housing 20 from the counterpart housing 2 (see FIG. 6). That is, the coming-off of the lever 30 is prevented in a reliable manner, not in the fully locked state in which the housing 20 is fully fitted in the counterpart housing 2 and the lever 30 is unlikely to come off, but in in the provisionally locked state in which the housing 20 is not fully fitted in the counterpart housing 2. Consequently, even if an external force is added to the lever 30 by a vibration or an impact in the provisionally locked state, the pivot guide bosses 26 is prevented from being pulled out from the pivot guide holes 36, so that the lever 30 is prevented from being dropped from the housing 20. In particular, the lever 30 can be effectively prevented from coming off when an external force is applied to the lever by a vibration or an impact or by being caught, for example, during transportation before it is joined to the counterpart housing 2.

Further, the engagement projections 27 extend along the pivot guide holes 36, and engage with the engagement stepped portions 38 only when the lever-type connector 10 is in the provisionally locked state. Thus, when moving the lever 30 to join the lever-type connector 10 to the counterpart housing 2, the sliding friction resistance resulting from the engagement projections 27 contacting the edge portions of the pivot guide holes 36 is suppressed, so that good operability of the lever 30 can be maintained. Moreover, since the engagement projections 27 extend along the pivot guide holes 36, the engagement projections 27 are not obstructive when the pivot guide bosses 26 are inserted into the pivot guide holes 36. Consequently, it is unnecessary to form notches or clearances for passing the engagement projections 27 through the pivot guide holes 36 of the side plates 31.

Moreover, the engagement projections 27 extending from the ends of the pivot guide bosses 26 are engaged with the engagement stepped portions 38 that are recessed on the outer sides of the side plates 31, this engagement structure can be provided within the range of the thickness of the side plates 31. That is, the coming-off of the lever 30 when an external force is applied can be prevented without increase in cost or decline in strength caused by applying processing such as the forming of notches or clearances on the counterpart housing 2 and without increase in the size of the housing 2 due to the pivot guide holes 36 protruding from the side plates 31.

Next, a lever-type connector according to another exemplary embodiment of the present invention will be described.

Figure 7A:
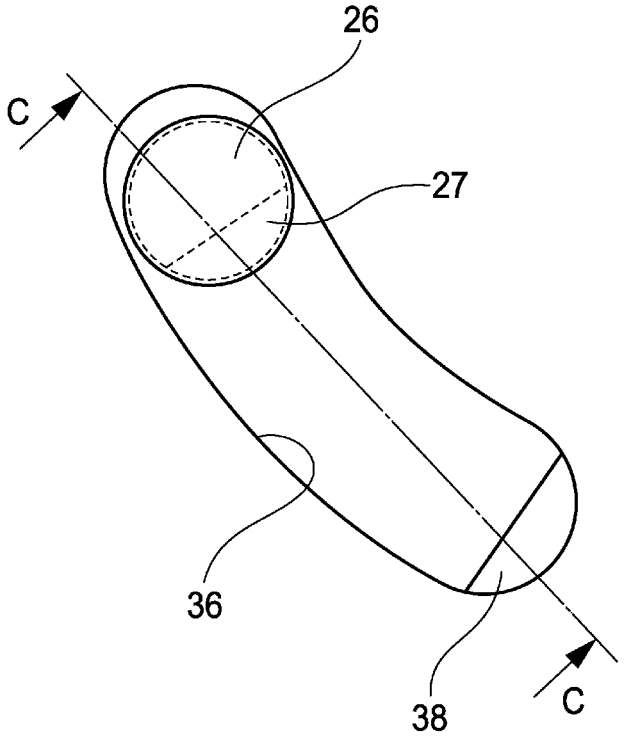
FIG. 7A is a side view of a pivot guide hole and a pivot guide boss in a fully locked state of a lever-type connector according to another exemplary embodiment of the present invention.
Figure 7B:
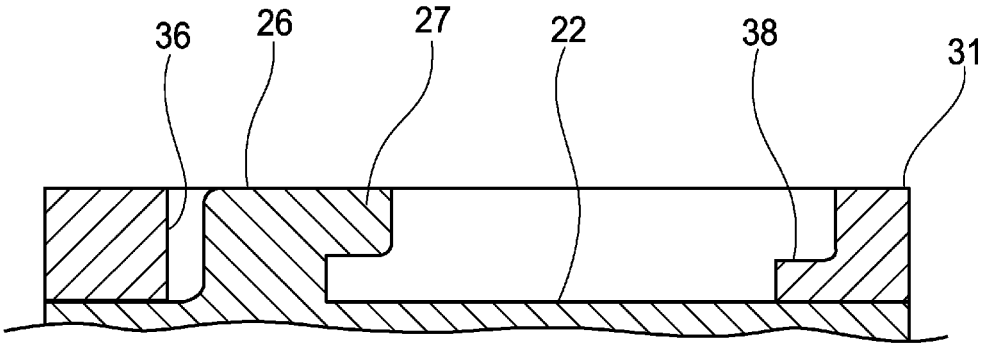
FIG. 7B is cross-sectional view taken along the line C-C of FIG. 7A.

While the engagement projections 27 extending sideward are integrally formed on the distal end portions of the pivot guide bosses 26 in the exemplary embodiment described above, the engagement projections 27 may be provided on the distal end portions of the pivot guide bosses 26 by forming the base portions of the pivot guide bosses 26 is a recessed manner as shown in FIGS. 7A and 7B. These engagement projections 27 also extend downward along the pivot guide holes 36. The engagement stepped portions 38 that are recessed on the outer sides are formed on the lower ends of the pivot guide holes 36 of the lever 30.

Figure 8A:
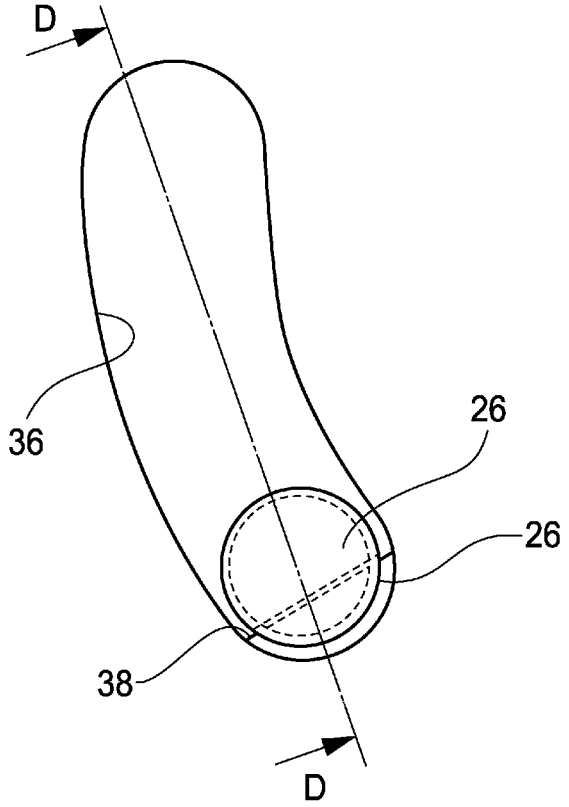
FIG. 8A is a side view of the pivot guide hole and the pivot guide boss in a provisionally locked state of the lever-type connector according to the same exemplary embodiment of FIG. 7A.
Figure 8B:
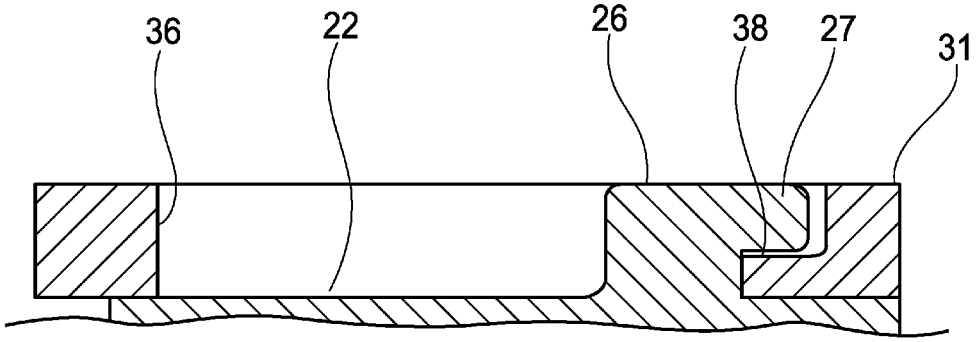
FIG. 8B is a cross-sectional view taken along the line D-D of FIG. 8A.
Figure 9A:
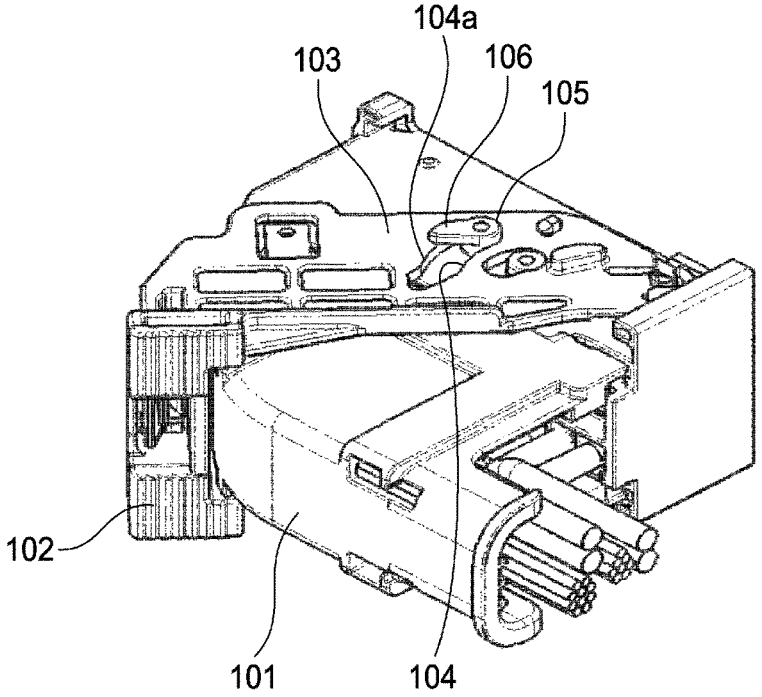
FIG. 9A is a perspective view of a related art lever-type connector in a provisionally locked state.
Figure 9B:
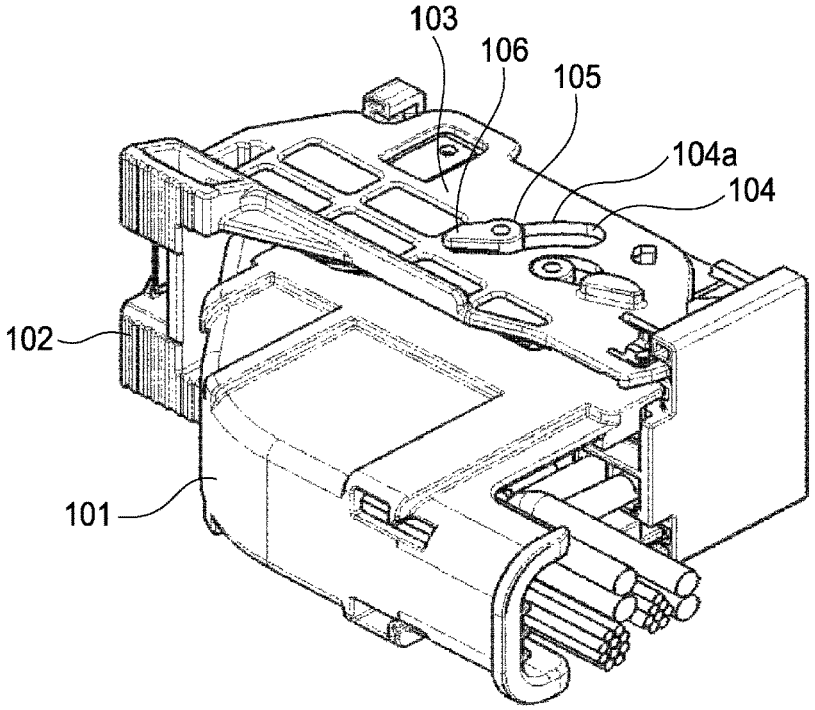
FIG. 9B is a perspective view of the related art lever-type connector in a fully locked state.

Also in this exemplary embodiment, as shown in FIGS. 8A and 8B, the engagement projections 27 of the pivot guide bosses 26 of the housing 20 engage with the engagement stepped portions 38 of the pivot guide hole 36 of the lever 30 in the provisionally locked state. Thereby, the movement of the side plates 31 of the lever 30 in a direction away from the side surfaces 22 of the housing 20 is restricted by the force of engagement between the engagement stepped portions 38 and the engagement projections 27. Consequently, in the provisionally locked state, the lever 30 does not come off from the housing 20 even if an external force such as a vibration or an impact is added thereto. Further, the operability of the lever 30 can be inhibited from deteriorating due to the sliding friction resistance caused when the engagement projections 27 come into contact with edge portions of the pivot guide holes 36 or the like when the lever 30 is moved at the time of joining to the counterpart housing 2, so that excellent operability can be ensured.

While the present invention has been described with reference to certain exemplary embodiments thereof, it will be understood by those skilled in the art that various changes and modifications may be made therein.

For example, in the exemplary embodiments described above, the lever 30 has the pair of side plates 31 and the operation portion 32 forming a U shape in a plan view, and the side plates 31 are provided along the respective side surfaces 22 of the housing 20. However, according to another exemplary embodiment of the present invention, only one side plate 31 may be provided. In this alternative structure, the side plate 31 and the operation portion 32 are arranged to form an L shape in a plan view, and the side plate 31 is provided along one of the side surfaces 22 of the housing 20.

Further, the lever-type connector 10 according to the exemplary embodiments described above has a structure in which the pivot guide bosses 26 of the housing 20 are inserted in the pivot guide holes 36 of the lever 30. However, according to another exemplary embodiment of the present invention, a lever-type connector may not have the pivot guide bosses 26 and the pivot guide holes 36, in which case the lever support bosses 25 may be formed to have the engagement projections 27 and the lever support holes 35 may be formed to have the engagement stepped portions 38.

Moreover, while the lever-type connector 10 according to the exemplary embodiments described above are configured such that the lever 30 is pivoted with respect to the housing 20, the present invention is applicable to other lever-type connectors in which the lever 30 be movable relative to the housing 20. For example, the present invention may be applied to a lever-type connector in which the lever 30 is slid relative to the housing 20.

According to an illustrative aspect of the exemplary embodiments described above, a lever-type connector (10) includes a housing (20) configured to be inserted into and pulled out from a fitting recess (3) formed in a counterpart housing (2) of a counterpart connector (1), and a lever (30) attached to the housing (20) so as to be movable relative to the housing (20), the lever (30) being configured to assist, during a movement of the lever (30), force for inserting and pulling out the housing (20) with respect to the counterpart housing (2). The lever (30) includes a side plate (31) provided along a side surface (22) of the housing (20), and an operation portion (32) connected to an end portion of the side plate (31). The housing (20) includes a boss (e.g., the pivot guide boss 26) provided on the side surface (22) of the housing (20). The side plate (31) of the lever (30) has an elongate hole (e.g., the pivot guide hole 36) into which the boss is inserted to restrict a moving range of the lever (30) with respect to the housing (20), and an engagement stepped portion (38) provided at at least one end of the elongate hole, the engagement stepped portion (38) being recessed on an outer side of the side plate (31). The boss has an engagement projection (27) provided at a distal end portion of the boss, the engagement projection (27) extending along the elongate hole and being engageable with the engagement stepped portion (38). The engagement stepped portion (38) and the engagement projection (27) engage with each other in a state (the provisionally locked state) in which the lever (30) has been moved in a direction that separates the housing (20) from the counterpart housing (2).

The lever (30) may further include a fulcrum engageable with the counterpart housing (2) to assist the force for inserting and pulling out the housing (20) with respect to the counterpart housing (2) during the movement of the lever (30).

The boss (e.g., the pivot guide boss 26) may be disposed inside the elongate hole (e.g., the pivot guide hole 36) without protruding from an outer surface of the side plate (31).

What is claimed is:

1. A lever-type connector comprising:

a housing configured to be inserted into and pulled out from a fitting recess formed in a counterpart housing of a counterpart connector; and a lever attached to the housing so as to be movable relative to the housing, the lever being configured to assist, during a movement of the lever, force for inserting and pulling out the housing with respect to the counterpart housing, wherein the lever comprises:

a side plate provided along a side surface of the housing; and an operation portion connected to an end portion of the side plate, wherein the housing comprises a boss provided on the side surface of the housing, wherein the side plate of the lever comprises:

an elongate hole into which the boss is inserted to restrict a moving range of the lever with respect to the housing; and an engagement stepped portion provided at at least one end of the elongate hole, the engagement stepped portion being recessed on an outer side of the side plate, wherein the boss comprises an engagement projection provided at a distal end portion of the boss, the engagement projection extending along the elongate hole and being engageable with the engagement stepped portion, and wherein the engagement stepped portion and the engagement projection engage with each other in a state in which the lever has been moved in a direction that separates the housing from the counterpart housing.

2. The lever-type connector according to claim 1, wherein the boss is disposed inside the elongate hole without protruding from an outer surface of the side plate.

3. The lever-type connector according to claim 1, wherein the lever further comprises a fulcrum engageable with the counterpart housing to assist the force for inserting and pulling out the housing with respect to the counterpart housing during the movement of the lever.

* * * * *